US008397615B2

(12) United States Patent
Poling

(10) Patent No.: US 8,397,615 B2
(45) Date of Patent: Mar. 19, 2013

(54) THERMALLY-INSULATING COVER FOR FIREARM SOUND SUPPRESSOR

(76) Inventor: Dale Avery Poling, Potomac, MT (US)

( * ) Notice: Subject to any disclaimer, the term of this patent is extended or adjusted under 35 U.S.C. 154(b) by 144 days.

(21) Appl. No.: 12/930,576

(22) Filed: Jan. 11, 2011

(65) Prior Publication Data

US 2012/0167435 A1 Jul. 5, 2012

Related U.S. Application Data

(60) Provisional application No. 61/336,041, filed on Jan. 16, 2010.

(51) Int. Cl.
*F41A 21/00* (2006.01)

(52) U.S. Cl. ..... 89/14.3; 442/136; 442/414

(58) Field of Classification Search ..... 89/14.1–14.4
See application file for complete search history.

(56) References Cited

U.S. PATENT DOCUMENTS

| | | | | | |
|---|---|---|---|---|---|
| 296,432 | A * | 4/1884 | Moebius | 62/312 |
| 3,130,414 | A * | 4/1964 | Bailey et al. | 2/2.5 |
| 3,413,180 | A * | 11/1968 | Smith | 442/222 |
| 4,346,643 | A * | 8/1982 | Taylor et al. | 89/14.1 |
| 4,762,048 | A * | 8/1988 | Higashi et al. | 89/14.1 |
| 4,896,437 | A * | 1/1990 | Johnson | 36/1.5 |
| 5,005,374 | A * | 4/1991 | Spitler | 62/259.3 |
| D349,010 | S * | 7/1994 | Johnson | D7/619.1 |
| 5,637,389 | A * | 6/1997 | Colvin et al. | 428/308.4 |
| D486,945 | S * | 2/2004 | Brock et al. | D29/126 |
| 7,735,406 | B1 * | 6/2010 | Olson | 89/14.3 |
| D630,335 | S * | 1/2011 | Wise et al. | D24/206 |
| 2003/0060107 | A1 * | 3/2003 | Gooliak | 442/131 |
| 2004/0116023 | A1 * | 6/2004 | Huang et al. | 442/328 |
| 2005/0208851 | A1 * | 9/2005 | Gooliak | 442/59 |
| 2008/0053109 | A1 * | 3/2008 | Quincy et al. | 62/4 |
| 2011/0100204 | A1 * | 5/2011 | Schlenkert et al. | 89/14.1 |

* cited by examiner

*Primary Examiner* — Samir Abdosh
(74) *Attorney, Agent, or Firm* — David O. Simmons

(57) ABSTRACT

A cover for use with a firearm sound suppressor comprises an insulating body and a retention apparatus attached to the insulating body. The insulating body includes one or more layers of thermally-insulating material. The insulating body is configured for being wrapped around the firearm sound suppressor. The retention apparatus includes a securing structure configured for being wrapped around the insulating body to secure the insulating body in a fixed position with respect to the firearm sound suppressor after the insulating body is wrapped around the firearm sound suppressor.

12 Claims, 2 Drawing Sheets

THERMALLY-INSULATING COVER FOR FIREARM SOUND SUPPRESSOR

CROSS REFERENCE TO RELATED APPLICATIONS

This non-provisional patent application claims priority from co-pending U.S. Provisional Patent Application having Ser. No. 61/336,041 filed Jan. 16, 2010 entitled "Suppressor Wrap", having a common applicant herewith and being incorporated herein in its entirety by reference.

FIELD OF THE DISCLOSURE

The disclosures made herein relate generally to accessories for firearms and, more particularly, to a thermally insulating cover for a firearm sound suppressor.

BACKGROUND

Sound suppressors serve as a valuable asset to law enforcement and military personnel. In many situations, a sound suppressor allows such personnel to maintain a concealed location when firing their firearm (e.g., rifle) in a hostile environment. The sound suppressor attenuates the discharge sound of the firearm so as to preclude or minimize the ability of using the sound of the firearm being discharged as a means of determining a location of the firearm.

Although a sound suppressor is very effective in acoustically concealing a location of a discharged firearm, such sound suppression results in a temperature of the sound suppressor being elevated relative to the ambient temperature. This is particularly true for situations where a sound suppressor is being used with a firearm being operated at a semi-automatic or fully automatic rate of fire. As such, a sound suppressor can become a readily available source of heat through which known thermal imaging devices (e.g., thermal imaging sight) can detect a location of a recently fired firearm. Furthermore, such heating of the sound suppressor makes removal and/or handling of the sound suppressor of a recently fired firearm undesirable.

Therefore, a sound suppressor cover that thermally insulates the sound suppressor sufficiently to reduce the ability to use thermal imaging devices to locate the sound suppressor (i.e., reduce its thermal signature) and to permit handling of a hot sound suppressor would be advantageous, desirable and useful.

SUMMARY OF THE DISCLOSURE

Embodiments of the present invention include a cover for sound suppressors (i.e., suppressors) typically used with a firearm (e.g., a rifle). Such a cover is referred to herein as a suppressor wrap. A suppressor wrap configured in accordance with an embodiment of the present invention allows an operator of a firearm on which the suppressor wrap in installed on a suppressor of the firearm to comfortably handle the suppressor when hot. Suppressor wraps in accordance with the present invention are preferably, but not necessarily, made from material that is flame retardant, flame resistance, and/or heat resistant. Advantageously, in addition to allowing an operator to handle a hot suppressor, a suppressor wrap configured in accordance with the present invention also reduces the thermal signature of the sound suppressor and provides a platform for attaching camouflage elements such as Gillie suit material, brush, branches, etc. Suppressor wrap configured in accordance with the present invention can be configured to fit different size (e.g., length and/or diameter) suppressors.

In one embodiment of the present invention, a cover for use with a firearm sound suppressor comprises an insulating body and a retention apparatus attached to the insulating body. The insulating body includes one or more layers of thermally-insulating material. The insulating body is configured for being wrapped around the firearm sound suppressor. The retention apparatus includes a securing structure configured for being wrapped around the insulating body to secure the insulating body in a fixed position with respect to the firearm sound suppressor after the insulating body is wrapped around the firearm sound suppressor.

In another embodiment of the present invention, a cover for use with a firearm sound suppressor comprises an insulating body and one or more retention straps attached to the insulating body. The insulating body includes a multi-layer thermally-insulating material. The insulating body is configured for allowing the insulating body to be wrapped around the firearm sound suppressor. The one or more retention straps are each configured for being wrapped around the insulating body and for securing the insulating body in a fixed position with respect to the firearm sound suppressor after the insulating body is wrapped around the firearm sound suppressor.

In another embodiment of the present invention, a cover for use with a firearm sound suppressor comprises an insulating body made from a multi-layer thermally-insulating fabric material. The insulating body is conformable for allowing the insulating body to be wrapped around the firearm sound suppressor. The multi-layer thermally-insulating material includes a layer of material made from fire retardant fibers. The layer of material made from fire retardant fibers defines an exterior face of the insulating body that contacts the firearm sound suppressor when the insulating body is wrapped around the firearm sound suppressor. The cover further comprises means for securing the insulating body in a fixed position with respect to the firearm sound suppressor after the insulating body is wrapped around the firearm sound suppressor. Such means for securing includes at least one of a retention strap attached to the insulating body and a lacing structure attached to the insulating body.

These and other objects, embodiments, advantages and/or distinctions of the present invention will become readily apparent upon further review of the following specification, associated drawings and appended claims.

DETAILED DESCRIPTION OF THE DRAWING FIGURES

Figure 1:
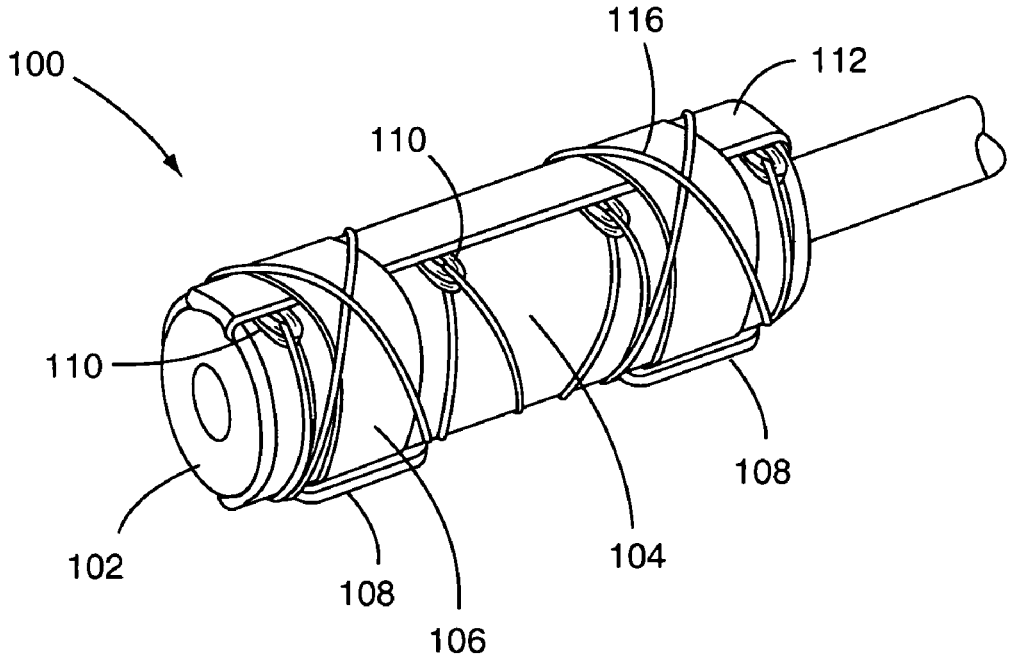
FIG. 1 is a perspective as-installed view showing the suppressor cover configured in accordance with an embodiment of the present invention in an as-installed configuration.
Figure 2:
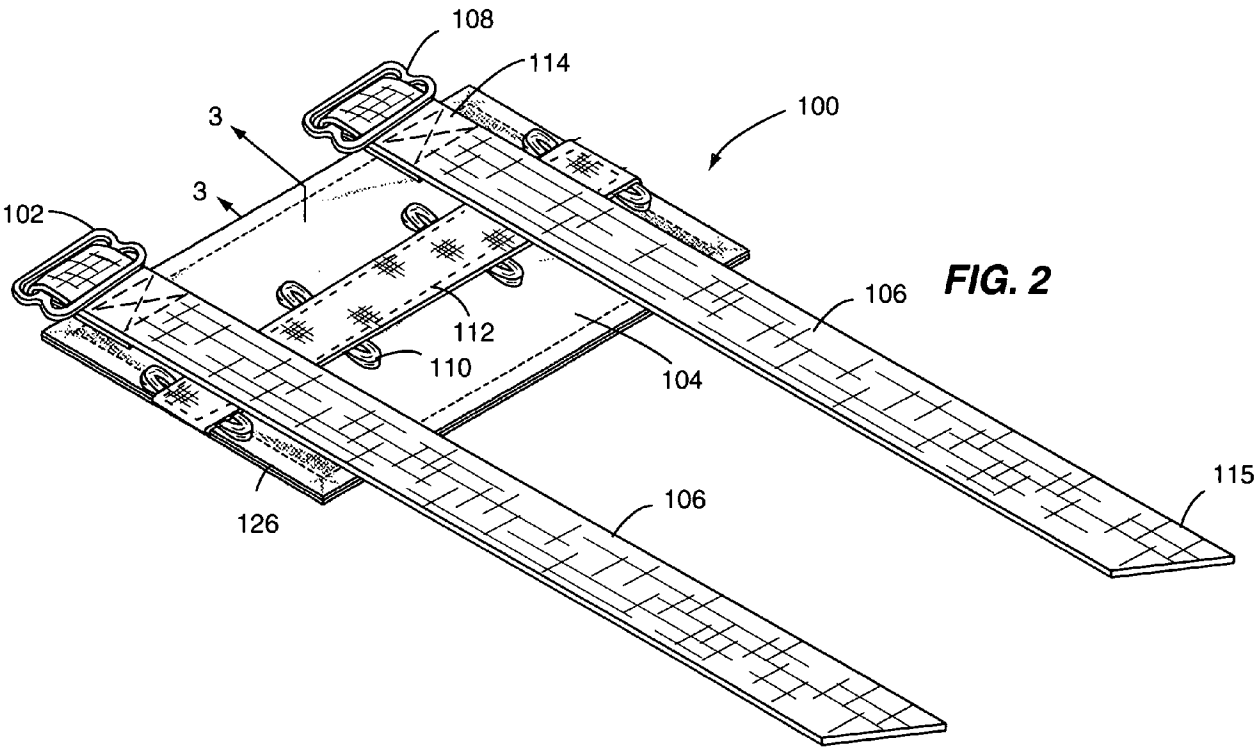
FIG. 2 is a perspective view showing upper surface and edge surfaces of the suppressor cover shown in FIG. 1 in an uninstalled configuration.

FIGS. 1 and 2 show a suppressor wrap 100 configured in accordance with the present invention. It is disclosed herein the suppressor wrap 100 represents one of many embodiments of a suppressor wrap (i.e., suppressor cover) configured in accordance with the present invention. As is disclosed herein, embodiments of a suppressor wrap (i.e., suppressor cover) configured in accordance with the present invention may be configured slightly or substantially different than the suppressor wrap 100 shown in FIGS. 1 and 2.

The suppressor wrap 100 includes an insulating body 104, retention straps 106, strap fasteners 108, looped cord eyelets 110, and an eyelet overlay strip 112. The looped cord eyelets are spaced apart from each other along a central portion of the insulating body 104. The eyelet overlay strip 112 extends over end portions of each one of the looped cord eyelets 110. The eyelet overlay strip 112 and the looped cord eyelets 110 are jointly secured to the insulating body 104 by means such as, for example, thread stitching, thermal stitching, thermal bonding, thermal, staking, adhesive, or the like, such that the eyelet overlay strip 112 reinforces attachment of the looped cord eyelets 110 to the insulating body 104. Opposing end portions of each one of the looped cord eyelets 110 is secured under the eyelet overlay strip 112. Alternatively, each one of the looped cord eyelets 110 can be attached directly to the insulating body 104 without the use of the eyelet overlay strip 112 (e.g., being, sewn or otherwise attached directly to the insulating body 104). Still further, it is contemplated herein that the looped cord eyelets 110 can be omitted.

Each one of the retention straps 106 is attached at a first end portion 114 thereof to the insulating body 104 by means such as, for example, thread stitching, thermal stitching, thermal bonding, thermal, staking, adhesive, or the like. One of the strap fasteners 108 is attached to the first end portion 114 of a respective one of the retention straps 106. Jointly, the retention straps 106 and the strap fasteners 108 can be used for securing the suppress wrap 100 to the suppressor 102 by wrapping the insulating body 104 around the suppressor 102, wrapping the retention straps 106 around the insulating body 104, and fastening a second end portion 115 of each retention straps 106 to the respective attached one of the strap fasteners 108. In one embodiment, each one of the strap fasteners 108 is a buckle made from metal, a heat resistant polymeric material, a ceramic material, or other material capable of withstanding heat from the suppressor 102.

It is disclosed herein that other suitable fastening means can be used in place of the retention straps 106 and the strap fasteners 108. In one example, the retention straps 106 and the strap fasteners 108 are omitted and the suppressor wrap is held in place by a lacing structure 116 that is threaded through the looped cord eyelets 110. Optionally, the lacing structure 116 can be used jointly with the retention straps 106 and the strap fasteners 108 for securing the suppresser wrap 100 on the suppressor 102. Advantageously, the lacing structure 116 serves as a structure to which camouflage elements (e.g., Gillie suit material, brush, branches, etc) can be attached to the suppressor 102. It is disclosed herein that the lacing structure 116 can be omitted and the looped cord eyelets 110 can be used for attaching camouflage elements to the suppressor 102. It is disclosed herein that all or a portion of the lopped cord eyelets 110 can be replaced by another type of structure that provides for lacing and/or camouflage attaching functionalities.

Figure 3:
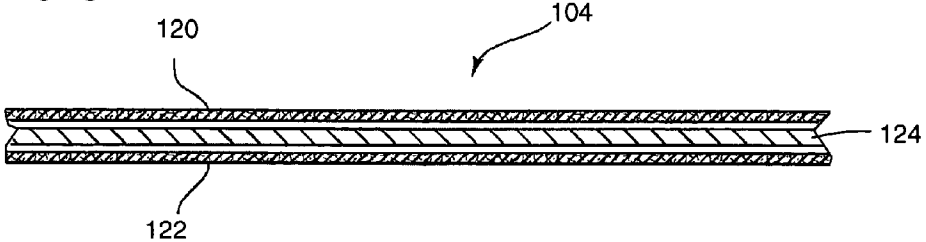
FIG. 3 is a cross-sectional view taken along the line 3-3 in FIG. 2.

Referring now to FIGS. 2 and 3, the insulating body 104 includes a first layer of material 120, a second layer of material 122, and a core layer of material 124 disposed between the first layer of material 120 and the second layer of material 122. Perimeter edge portion 126 of at least the first layer of material 120 and the second layer of material 122 are secured by means such as, for example, thread stitching, thermal stitching, thermal bonding, thermal staking, adhesive, or the like.

Preferably, all of the layers of material 120, 122, 124 of the insulating body 104, the retention straps 108, the looped cord eyelets 110, and the eyelet overlay strip 112 offer fire-retardant and/or heat-resistant properties. As such, it is preferred for all of the layers of material 120, 122, 124 of the insulating body 104, the retention straps 108, the looped cord eyelets 110, and the eyelet overlay strip 112 to be made from respective fiber/fabric that offers fire-retardant and/or heat-resistant properties. In one specific embodiment of the suppressor wrap 100, the first and second layers of material 120, 122 are made from respective fire-retardant and/or heat-resistant fabric and the core layer of material 124 is made from a heat-diffusing and/or heat-reflective material.

Preferably, the insulating body 104 is characterized by the ability to withstand direct exposure to a flame or another heat source having a temperature of at least about 1500.degree. C. on the second layer of material 122 for at least 1 minute without transferring significant heat to the second opposite face. To this end, the fire-retardant and heat-resistant material from which the second layer of material 122 and, optionally, the first layer of material 120 are made from a material including fibers chosen from the group consisting of oxidized polyacrylonitrile (O-PAN), reinforced O-PAN, p-aramid (e.g., Kevlar), m-aramid (e.g., Nomex), melamine (e.g., BASOFIL), polybenzimidazole (PBI), polyimides (e.g., KAPTON), polyamideimides (e.g., KERMEL), partially oxidized polyacrylonitriles (e.g., FORTAFIL OPF), novoloids (e.g., phenol-formaldehyde novolac), poly(p-phenylene benzobisoxazole) (PBO), polyp-phenylene benzothiazoles) (PBT); polyphenylene sulfide (PPS), flame retardant viscose rayons, polyetheretherketones (PEEK), polyketones (PEK), polyetherimides (PEI), chloropolymeric fibers (e.g., FIBRAVYL L9F), modacrylics (e.g., PROTEX), fluoropolymeric fibers (e.g., TEFLON TFE), and combinations thereof.

In a preferred embodiment, the first and second layers of material 120, 122 are made from reinforced oxidized polyacrylonitrile fabrics, which are sold under the trade name CARBONX. Reinforced oxidized polyacrylonitrile (i.e., CARBONX) is composed of oxidized polyacrylonitrile (O-PAN) fibers and at least one strengthening and/or reinforcing fiber. O-PAN fibers have tremendous fire-retardant and heat-resistant properties, but they lack tensile strength. Strengthening and/or reinforcing fibers or filaments may be included with O-PAN in order to increase the tensile strength of the resultant fibers. Fibers, yarns, and fabrics made of reinforced O-PAN, which are suitably configured for being used in a suppressor wrap configured in accordance with the present invention disclosed in a number of United States patents, including U.S. Pat. Nos. 6,358,608, 6,827,686, 6,800,367, 7,087,300, and in a number of published U.S. patent applications, including US published patent applications Nos. 2009/0258180, 2009/0209155, and 2007/0231573.

The O-PAN and the reinforcing fibers and/or strengthening filaments are blended together so as to form a fibrous blend having increased strength and abrasion resistance compared to a yarn, fabric, or felt consisting exclusively of oxidized polyacrylonitrile fibers. Preferably, O-PAN is included in an amount in an range from about 50 percent to about 99.9 percent by weight of the fiber blend with the remainder being made up of reinforcing fibers and/or strengthening filaments. More preferably, the fibrous blend includes O-PAN fibers in a range from about 75 percent to about 99.5 percent by weight of the fibrous blend, with the remainder consisting of reinforcing fibers and/or strengthening filaments. Even more preferably, the fibrous blend includes O-PAN fibers in a range from about 85 percent to about 99 percent by weight of the fibrous blend, with the remainder consisting of reinforcing fibers and/or strengthening filaments. Most preferably, the fibrous blend includes O-PAN fibers in a range from about 90 percent to about 97 percent by weight of the fibrous blend, with the remainder consisting of reinforcing fibers and/or strengthening filaments.

In one embodiment, the strengthening fibers include at least one of polybenzimidazole, polyphenylene-2,6-benzobisoxazole, modacrilic, p-aramid, m-aramid, a polyvinyl halide, wool, a fire resistant polyester, a fire resistant nylon, a fire resistant rayon, cotton, or melamine. In another embodiment, the strengthening filaments include at least one of metallic filaments, high strength ceramic filaments, high strength polymer filaments, and combinations thereof. Reinforced O-PAN fibers may be assembled into woven fabric or non-woven felt materials. In one embodiment, at least one of the fabric layers may include a non-woven material. In another embodiment, at least one of the fabric layers may include a woven material.

It is disclosed herein that suitable examples of fire-retardant and heat-resistant materials (e.g., fabrics) from which the layers of material 120, 122, 124 of the insulating body 104, the retention straps 108, the looped cord eyelets 110, and/or the eyelet overlay strip 112 can be made include materials including fibers having a limiting oxygen index (LOI) of at least 50. In this manner, such elements of the suppressor wrap 100 made from such fibers will not support combustion when exposed to heat generated by a typical suppressor. LOI refers to the minimum concentration of oxygen necessary to support combustion of a particular material. A fire-retardant and heat-resistant fabric having an LOI of 50 will not support combustion at an oxygen concentration lower than 50%. The Earth's atmosphere includes about 21% oxygen and a mix of other gases. This means that a fire-retardant and heat-resistant fabric having an LOI of 50 will generally not support combustion in the Earth's atmosphere. As disclosed above, one example of a fiber that is preferentially configured for use in making the various fabrics and straps in the present invention is offered under the trade name of CARBONX by Chapman Industries. CARBONX fiber can be provided in various known forms such as, for example, knit fabric, woven fabric, non-woven fabric, woven fabric strapping, and the like (i.e., CARBONX fabric). CARBONX fabrics will not ignite, burn, melt, shrink or significantly decompose when exposed to intense flame, molten metal, or arc flash. Even after intense exposure, CARBONX maintains its integrity and continues to protect. In at least one embodiment of the present invention, fabrics from which a suppressor wrap in accordance with the present invention are made will exhibit substantially the same of effectively the same thermal and flammability performance. For example, in a preferred embodiment of the present invention, the second layer of material 122 is made from CARBONX BO3RC fabric, which is a needle punch felt material.

The core layer of material 124 enhances the fire-resistant and heat-blocking characteristics of the insulating body 104. For example, the core layer of material 124 can block the passage of hot gases through the insulating body 104, can reflect heat away from the insulating body 104, and can increase the time required to burn through the insulating body 104 by diffusing heat away from the site where heat is applied. To this end, the core layer of material 124 can be selected from the group consisting of aluminum foil, metalized polyimide film, metalized fire-resistant fabric, and combinations thereof. In a preferred embodiment, the core layer of material 124 is aluminum foil. More preferably, the core material 18 is an industrial grade aluminum foil. Industrial grade aluminum foil differs from the common kitchen variety in that the industrial grade is typically a purer grade of aluminum, it is uncoated, and it is available in a wider range of thicknesses. Preferably, the aluminum foil has a thickness in a range between about 0.004 mm and about 0.15 mm. More preferably, the aluminum foil has a thickness in a range between about 0.005 mm and about 0.05 mm. Most preferably, the aluminum foil has a thickness in a range between about 0.006 mm and about 0.02 mm. It is disclosed herein that thinner aluminum foils provide excellent fire and heat protection while also suppressing the crinkle sound that thicker foils can produce.

It is disclosed herein that the core layer of material 124 can be a multi-layer layer of material (e.g., one or more layers of fire-resistant fabric and/or one or more layers of metallic and/or metalized materials). While a core that includes a single layer of heat-diffusing and/or heat-reflective core material offers excellent protection against heat and fire, multiple thin layers of heat-diffusing and/or heat-reflective core material can be superior to one thick layer. Examples of such materials from which one of more layers of a multi-layer embodiment of the core layer of material 124 can be made include, but are not limited to felted fabrics (e.g., wool felt), woven fabrics (e.g., wool), spun refractory fibers (e.g., spun kaolin wool, an example of which is sold by Thermal Ceramics Co. under the brand name KAOWOOL-RT), aerogel, insulating fire clay, pumice and combinations thereof.

In the preceding detailed description, reference has been made to the accompanying drawings that form a part hereof, and in which are shown by way of illustration specific embodiments in which the present invention may be practiced. These embodiments, and certain variants thereof, have been described in sufficient detail to enable those skilled in the art to practice embodiments of the present invention. It is to be understood that other suitable embodiments may be utilized and that logical, mechanical, chemical and electrical changes may be made without departing from the spirit or scope of such inventive disclosures. To avoid unnecessary detail, the description omits certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A firearm sound suppressor cover, comprising:

an insulating body including a first layer of heat-resistant material and a layer of heat-reflective material in direct contact with the first layer of heat resistant material, wherein the insulating body is configured for being wrapped around a firearm sound suppressor and wherein the first layer of heat resistant material defines an exterior face of the insulating body that contacts the firearm sound suppressor when the insulating body is wrapped around the firearm sound suppressor; and a retention apparatus attached to the insulating body, wherein the retention apparatus includes a securing structure configured for being wrapped around the insulating body to secure the insulating body in a fixed position with respect to the firearm sound suppressor after the insulating body is wrapped around the firearm sound suppressor;

wherein the securing structure includes a retention strap and a lacing structure; and wherein the lacing structure includes a plurality of lace receiving apertures that spaced apart from each other along a length of the insulating body such that the lacing structure extends along a length of the firearm sound suppressor when the insulating body is wrapped thereon.

2. The cover of claim 1 wherein the layer of heat-reflective material includes at least one of a layer of metal foil, a layer of metalized polymeric film, and a layer of metalized fabric.

3. The cover of claim 1 wherein the insulating body includes a second layer of heat-resistant material having a LOI of at least 50.

4. The cover of claim 1 wherein:

the insulating body includes a second layer of heat-resistant material having a LOI of at least 50; and the layer of heat-reflective material is positioned between the first and second layers of heat-resistant material.

5. The cover of claim 3 wherein:

the insulating body includes a second layer of heat-resistant material; and the layer of heat-reflective material is positioned between the first and second layers of heat-resistant material.

6. The cover of claim 5 wherein the layer of heat-reflective material includes at least one of a layer of metal foil, a layer of metalized polymeric film, and a layer of metalized fabric.

7. A firearm sound suppressor cover comprising:

an insulating body including a multi-layer thermally-insulating material, wherein the insulating body is conformable for allowing the insulating body to be wrapped around a firearm sound suppressor, wherein the multi-layer insulating body includes a first layer of heat-resistant material, a second layer of heat-resistant material, and a layer of heat-reflective material positioned between the first and second layers of heat-resistant material, wherein the first layer of heat-resistant material is made from fire retardant fibers, wherein the first layer of heat-resistant material defines an exterior face of the insulating body that contacts the firearm sound suppressor when the insulating body is wrapped around the firearm sound suppressor and wherein the layer of heat-reflective material is in direct contact with at least the first layer of heat resistant material;

a plurality of retention straps attached to the insulating body, wherein the retention strap are configured for being wrapped around the insulating body and for securing the insulating body in a fixed position with respect to the firearm sound suppressor after the insulating body is wrapped around the firearm sound suppressor; and a lacing structure attached to the insulating body, wherein the lacing structure is configured for securing the insulating body in a fixed position with respect to the firearm sound suppressor after the insulating body is wrapped around the firearm sound suppressor and wherein the lacing structure includes a plurality of lace receiving apertures that spaced apart from each other along a length of the insulating body such that the lacing structure extends along a length of the firearm sound suppressor when the insulating body is wrapped thereon.

8. The cover of claim 7 wherein the layer of heat-reflective material is one of a layer of metal foil, a layer of metalized polymeric film, a layer of metalized fabric.

9. The cover of claim 8 wherein the first and second layers of heat-resistant material have a LOI of at least 50.

10. The cover of claim 7 wherein the straps and the lacing structure are made from a respective fire retardant material.

11. The cover of claim 10 wherein the layer of heat-reflective material is one of a layer of metal foil, a layer of metalized polymeric film, a layer of metalized fabric.

12. The cover of claim 7 wherein:

the lacing structure includes a plurality of looped cord eyelets; and each one of said looped cord eyelets defines at least one of said lace receiving apertures.

* * * * *